US005616409A

United States Patent [19]

Matsuda et al.

[11] Patent Number: 5,616,409

[45] Date of Patent: Apr. 1, 1997

[54] INK JET RECORDING MEDIUM AND RECORDING METHOD

[75] Inventors: Tsukasa Matsuda; Kiyoshi Hosoi, both of Ebina; Ken Hashimoto, Minami-ashigara, all of Japan

[73] Assignee: Fuji Xerox Co., Ltd., Tokyo, Japan

[21] Appl. No.: 24,756

[22] Filed: Mar. 2, 1993

[30] Foreign Application Priority Data

Mar. 11, 1992 [JP] Japan ..... 4-052589

[51] Int. Cl.[6] ..... B41M 5/00

[52] U.S. Cl. ..... 428/323; 428/195; 428/206; 428/211; 428/341; 428/342; 428/537.5

[58] Field of Search ..... 428/195, 206, 428/211, 342, 537.5, 323, 341

[56] References Cited

U.S. PATENT DOCUMENTS 5,266,383 11/1993 Sakaki et al. ..... 428/195

FOREIGN PATENT DOCUMENTS

| | | |
|---|---|---|
| 58-72495 | 4/1983 | Japan . |
| 60-27588 | 2/1985 | Japan . |
| 63-1583 | 1/1988 | Japan . |
| 2-16079 | 1/1990 | Japan . |

*Primary Examiner*—Pamela H. Schwartz
*Attorney, Agent, or Firm*—Oliff & Berridge

[57] ABSTRACT

An ink jet recording medium is disclosed, comprising a coating formed on at least one surface of a substrate, characterized in that said substrate has an apparent density of 0.60 to less than 0.75 g/cm$^3$ and a Steckigt sizing degree of 2 to 18 seconds and the coating is formed by applying a coating agent containing a white pigment, of which the BET specific surface is 100 to 400 m$^2$/g at a rate in the range of 2 to 10 g/m$^2$.

An ink jet recording method is also disclosed, characterized in that recording is performed using water-color ink, of which the surface tension at 20° C. is 40 dyne/cm, on an ink jet recording medium.

9 Claims, No Drawings

INK JET RECORDING MEDIUM AND RECORDING METHOD

FIELD OF THE INVENTION

This invention relates to an ink jet recording medium whose reproduction quality, clarity and resolution of color image and ink absorbability is excellent in ink jet recording using water-color ink, and an ink jet recording method.

BACKGROUND OF THE INVENTION

In ink jet recording using water-color ink, characteristics such as quick absorption of ink, reproduction quality, and clarity and resolution of the ink coloring material on a recording medium are required for an ink jet recording medium. Conventionally, various proposals have been made to provide a recording medium with such characteristics. Japanese examined patent publication Sho 60-27588 (1985) describes a recording medium whose ink absorbability is improved by having no coating on an unsized paper.

Such a recording medium, however, has problems that in spite of quick ink absorbability, the ink penetrates deeply into the paper, resulting in poor ink reproduction quality and concentration. Penetration of ink in the direction orthogonal to thickness is also quick, and this spreading means that high resolution cannot be obtained. Further, feathering, and bleeding following the fibers occurs, which provides very poor reproduction.

To solve these defects, for example, Japanese unexamined patent publication Sho 58-72495 (1983) describes a recording medium having a thick coating of high ink absorbability on a substrate of high sizing degree.

As such a material requires a high proportion of pigment in the coating and a thick coating, its feel and appearance are different from the plain paper used for office copying purposes and uncoated printing paper. Further, if it is written on by a writing tool having a hard point, the coating is broken and it is difficult to write on; additionally powdery peeling may be caused by folding or friction, causing feeding failure by the attachment of loose coating to a feed roller or head clogging.

To solve these defects, Japanese unexamined patent publication Sho 63-1583 (1988) describes a recording medium having a thin coating, a Steckigt sizing degree of the substrate of not more than 5 seconds, a high bulk density, with a pore ratio of not more than 50 percent, and a specified filler ratio. Japanese unexamined patent publication Hei 2-16079 (1990 ) describes a recording medium having a roughness index of the coating of at least 10 ml/m$^2$ and a BeKK smoothness of the coating of not more than 20 seconds.

The recording medium of Japanese unexamined patent publication Sho 63-1583 (1988), however, has excellent ink absorbability, but for color reproduction is liable to have inter-color bleeding caused by ink penetration across the borders between portions of adjoining colors and superimposed portions of different colors.

In the recording medium of Japanese unexamined patent publication Hei 2-16079 (1990), attempts were made to improve the inter-color bleeding by reducing the amount of coating and roughening the coating surface, but especially in high speed and high ink jet density recording, there is only a short interval between printing the first color and printing the second color and the amount of ink for a unit area is high, so surface roughening is not sufficient to achieve satisfactory quality. Further, surface roughening allows the ink to enter the concave portions of the medium, and makes the spreading of ink drops in the medium surface uneven, which reduces the image reproduction.

SUMMARY OF THE INVENTION

It is an object of the present invention to provide an ink jet recording medium and a recording method free of the defects found in the conventional art.

It is another object of the present invention to provide an ink jet recording medium and a recording method free of inter-color bleeding in high speed and high bulk density color recording.

It is a further object of the present invention to provide an ink jet recording medium and a recording method capable of high quality image formation, which is also excellent in reproduction quality, clarity and resolution.

Additional objects and advantages of the invention will be set forth in part in the description which follows and in part will be apparent to a person with ordinary skill in the art from the description, or may be learned by practice of the invention.

This invention relates to an ink jet recording medium having a coating formed on at least one surface of a substrate, characterized in that said substrate has an apparent density of 0.60 to less than 0.75 g/cm$^3$ and a Steckigt sizing degree of 2 to 18 seconds, and that the coating is formed by applying coating agent containing a white pigment, of which the BET specific surface is 100 to 400 m$^2$ /g, at a rate within the range of 2 to 10 g/m$^2$.

This invention also relates to an ink jet recording method, characterized in that recording is performed using water-color ink, of which the surface tension at 20° C. is 40 dyne/cm, on an ink jet recording medium.

DETAILED DESCRIPTION OF THE INVENTION

The present inventors have carried out studies to solve the problems, and it was found that, concerning a substrate for an ink jet recording medium, the pore structure of a substrate was important especially for solving the inter-color bleeding problem, and it was necessary to provide at least a specified pore density. It was also found that the shape and size of dots, and image density were influenced by the material and the structure of a coating formed on at least one surface of the substrate, which was influential to the reproduction quality, clarity and resolution of an image. Further, it was found that, if color recording was carried out, an image of higher quality can be obtained by using a specified water-color ink, which prevents inter-color bleeding from occurring.

In this invention, a recording medium having a coating agent containing a white pigment of preferably 50 to 85 percent by weight, of which the BET specific surface is 100 to 400 m$^2$ /g applied at a rate within the range of 2 to 10 g/m$^2$ to at least one surface of a substrate of which the apparent density is 0.60 to less than 0.75 g/cm$^3$ and of which the Steckigt sizing degree is 2 to 18 seconds is used, by which ink ejected from the recording head is absorbed effectively in the pores of the large-specific-surface white pigment of the coating, and the ink shows vivid reproduction quality and proper spreading of dots. Further, ink solvent is absorbed quickly by the capillary force of the many pores of the substrate having a low apparent density. As the medium also has many pores inside the substrate, there is no ink penetration to the coating, and an image of high quality which is sharp and excellent in resolution, free of inter-color bleeding in the adjacent and superimposed portions of different colors can be obtained, even if the amount of ink for a unit area is high as a solid image.

If recording is performed using water-color ink, of which the surface tension at 20° C. is not more than 40 dyne/cm, on the recording medium, the wettability of ink to the substrate is even better and ink is absorbed in the substrate even more quickly, so that an image of high quality free of inter-color bleeding and which is excellent in resolution and reproduction quality can be obtained.

As the amount of the coating is small, 2 to 10 g/m$^2$, a recording medium which has an excellent coating layer strength and a feel and an appearance similar to normal plain paper can be obtained.

It is necessary that the apparent density as measured by JIS P8118 of a substrate used for the recording medium of this invention is 0.60 to less than 0.75 g/cm$^3$, preferably from 0.65 to 0.73 g/cm$^2$. If the apparent density exceeds 0.75 g/cm$^3$, the capacity of pores for absorbing ink inside the substrate are reduced, and inter-color bleeding occurs in the superimposed portions of colors and adjacent portions of different colors. If the apparent density is less than 0.60 g/cm$^3$, inter-fiber bonding areas forming the substrate are smaller and the strength of the substrate declines, resulting in phenomena such as peeling caused by friction of the recording medium with a feed roller in feeding and offset caused by excessive absorption of ink in the pores of the substrate.

To obtain a substrate of such an apparent density, it is necessary that the substrate has a basis weight of 50 to 100 g/m$^2$, preferably 60 to 90 g/m$^2$ and a thickness of 65 to 150 μm, preferably 80 to 140 μm, and it is preferable to control the basis weight and the thickness so that the pore capacity for a unit area of the substrate as measured by the mercury injection method in accordance with the J.TAPPI sheet and pulp testing method No. 48-85 is at least 37 ml/m$^2$, preferably at least 40 ml/m$^2$. If the pore capacity for a unit area of the substrate as measured by the mercury injection method is less than 37 ml/m$^2$, inter-color bleeding occurs, which is undesirable. If the thickness exceeds 150 μm, the buckling force increases following the increased stiffness of the medium, leading to problems in feeding in the recording apparatus. If the thickness is less than 65 μm, offset occurs, which is undesirable.

The Steckigt sizing degree by JIS P8122 of a substrate is 2 to 18 seconds, preferably 5 to 15 seconds. If the Steckigt sizing degree exceeds 18 seconds, much ink cannot be absorbed in a short time in spite of the many pores in the substrate, and inter-color bleeding occurs. If the Steckigt sizing degree is less than 2 seconds, offset occurs and the ink absorbing area in the substrate is increased, resulting in the swelling of the substrate, and the recording medium contacts the recording head, which leads to smudging. Further, drying of ink attaching to the recording media causes considerable wrinkling, which is undesirable.

For a pulp used for the substrate of this invention, chemical pulps such as hardwood bleached kraft pulp, softwood bleached kraft pulp, high yield pulps such as groundwood pulp or thermo-mechanical pulp, recycled pulps and non-wood pulps such as cotton pulp can be used. It is possible to mix synthetic fiber, glass fiber or the like in the pulp depending on the application. To prepare a pulp having an apparent density of 0.60 to less than 0.75 g/cm$^3$, the Freeness of these pulps is controlled to be 350 to 750 ml C. S. F. (Canadian Standard Freeness), preferably 400 to 700 ml C. S. F. by the measuring method of JIS P8121. If the Freeness is less than 350 ml C. S. F., the medium has high bulk density, and it is difficult to obtain a substrate having an apparent density of less than 0.75 g/cm$^3$. If the Freeness exceeds 750 ml C. S. F., the stiffness of the medium is greatly reduced, which is undesirable.

For a filler of a substrate, white fillers such as ground lime, precipitated calcium carbonate, talc, kaolin, titanium dioxide, zeolite, or white carbon can be used. The content of the filler is at least 5 percent by weight, preferably at least 10 percent by weight of the substrate to increase the pores in the substrate and to improve the opacity. If the filler in the substrate exceeds 30 percent by weight, the strength of the substrate declines and paper dust problems occur, so it is preferable that the content of filler is 5 to 30 percent by weight, and more preferably 10 to 25 percent by weight.

Either an acid or a neutral paper making process can be employed, but the above described fillers must be chosen depending on the process. A neutral paper making process is preferable in respect of the reproduction quality of colorants in ink, especially dyes, and the weatherproof qualities of an image.

Retention agents and stiffness agents can be added to the substrate as required and cationized polymer can also be added to the substrate to add water resistance to an image.

A recording medium of this invention has a coating formed on at least one surface of a substrate by applying a coating agent containing a white pigment, of which the BET specific surface is 100 to 400 m$^2$ /g, to the substrate at a rate within the range of 2 to 10 g/m$^2$. If a substrate of high absorbability is used, as the coating thickness is small, 2 to 10 g/m$^2$, very fine powder having a high specific surface is used for the pigment of the coating, and it is preferable that the pigment is at least 50 percent by weight of the coating.

A white pigment having a BET specific surface of 100 to 400 m$^2$ /g, preferably 200 to 350 m$^2$/g and an average particle diameter of 2 to 15 μm can be used for a pigment of a coating agent of this invention. For example, amorphous silica, alumina or the like can be used. It is preferable that the pigment is 50 to 85 percent by weight, more preferably 60 to 80 percent by weight of the coating. If the BET specific surface of the pigment is less than 100 m$^2$ /g, the amount of dye in the ink absorbed by the pigment of the coating decreases, resulting in a decline in the image density together with a decline in the ink absorbing speed of the coating, which leads to inter-color bleeding. If the BET specific surface of the pigment is at least 200 m$^2$ /g, the ink reproduction quality is good and inter-color bleeding does not occur. If it exceeds 350 m$^2$ /g, the hardness of the pigment is gradually reduced and if it exceeds 400 m$^2$ /g, the pigment is so soft that it is hard to write on the coating with a writing tool such as a pencil.

If the average particle diameter of the pigment is less than 2 μm, it is hard to write on the layer with a pencil, and if it exceeds 15 μm, the shape of dots is uneven and inter-color bleeding is caused by the influence of the two-dimensional structure, in another words, ink flow along the surface of the pigments. Even if a coating is formed by applying a coating agent containing a pigment, of which the BET specific surface is 100 to 400 m$^2$ /g, at a rate within the range of 2 to 10 g/m$^2$ on a substrate having an apparent density of 0.60 to less than 0.75 g/cm$^3$ and a Steckigt sizing degree of 2 to 18 seconds, if the content of the pigment is less than 50 percent by weight of the coating, the same effects as when the BET specific surface of the pigment is less than 100 $m^2$/g, in other words, inter-color bleeding or a decline in the image density occur. If the content of the pigment exceeds 85 percent by weight, the strength of the coating declines, powdery peeling occurs and it is hard to write on the layer with a writing tool such as a pencil, which is undesirable. Amorphous silica or the like can be modified with cationic metal ions such as calcium, aluminum or magnesium to have water resistance and light fastness.

As the binder of the coating layer may be used any one of or a combination of two or more of: polyvinyl alcohol derivatives such as completely saponified polyvinyl alcohol, partially saponified polyvinyl alcohol, silanol group modified vinyl alcohol copolymer; cellulose derivatives such as carboxymethyl cellulose, hydroxyethyl cellulose, hydroxypropyl methyl cellulose; water soluble polymers such as polyvinyl pyrolidone, starch oxide, modified starch, gelatin, casein, or acrylic acid type polymers. Further, polymers dispersed in water such as vinyl acetate emulsion, styrene butadiene latex, or acrylic type emulsion can be added depending on the application. Polyvinyl alcohol type polymers such as completely saponified polyvinyl alcohol, partially saponified polyvinyl alcohol, or silanol group modified vinyl alcohol copolymer are preferable in respect of ink absorbability and the strength of the coating, and silanol group modified vinyl alcohol copolymer is most preferable because it improves the strength of the coating more, which increases the content of the pigment to absorb dye.

To add water resistance to a water-color ink image formed on the coating, there may be incorporated in the coating at least one component, selected from the group consisting of: amine type polymers such as polyethylene imine or polyaryl amine; cationic water soluble polymers such as ammonium salt of amine type polymer or copolymer of acryl type compound and ammonium salt of amine type polymer; or a water soluble metal salt. Further, a fluorescent brightening agent, a surfactant, a fungicide or a dispersant can be contained in the binder as required.

The above described coating agent is applied at an amount within the range of 2 to 10 g/$m^2$, preferably 5 to 8 g/$m^2$. If the amount of coating is less than 2 g/$m^2$, fibers project partially from the recording medium surface, and the shape of ink dots is uneven. If it exceeds 10 g/$m^2$, the strength of the coating declines and the characteristics of plain paper tend to be lost.

In the recording medium of this invention, it is preferable that the substrate is made to have an apparent density of 0.60 to less than 0.75 g/$cm^3$ and a BeKK smoothness of at least 25 seconds by applying treatment such as calendering to the recording medium surface to obtain a circular dot free of distortion and roughness.

In the recording method of this invention, recording is carried out using conventional water-color ink on a specified recording medium. In color recording, an image which is excellent in reproduction quality, clarity and resolution and free of inter-color bleeding can also be obtained.

Particularly, with the recording method of this invention, an image of higher quality can be obtained by using water-color ink, of which the surface tension at 20° C. is not more than 40 dyne/cm on the specified recording medium.

Ejected ink is absorbed by the substrate after passing through the coating of the recording medium, and while passing the coating, the ink is absorbed effectively by the pigment having a large specific surface. After that, the ink, with a low surface tension, is absorbed instantly by the substrate with its pores and high absorption. Therefore, inter-color bleeding does not occur in the superimposed portions of solid images of at least two colors and adjacent portions of solid images of two colors. Further, quick absorption of ink in the substrate can reduce the ink spreading in the coating, and a sharp image having a high resolution can be obtained.

For a dye of water-color ink used in this recording method, a known water soluble acid dye, direct dye, basic dye, reactive dye, food dye or the like can be used. These dyes may be 0.5 to 15 percent by weight, preferably 1 to 10 percent by weight of the ink. Dispersing dyes, polymer colored by pigments, wax or the like may also be used as colorants as required.

It is preferable that the main solvent of the water-color ink is deionized water. It is also preferable to include a moisturizing agent in the ink to prevent drying in the recording head nozzle, and polyvalent alcohols such as ethylene glycol, diethylene glycol or other substances can be used for a moisturizing agent.

The surface tension at 20° C. of the water-color ink must be controlled to be not more than 40 dyne/cm, preferably 25 to 40 dyne/cm, and more preferably 30 to 40 dyne/cm. If the surface tension at 20° C. of the ink exceeds 40 dyne/cm, inter-color bleeding occurs, and if it is less than 30 dyne/cm, ink ejected from the printing head tends to be unstable and the kind of usable print head is restricted. Further, if it is less than 25 dyne/cm, ejection failures from the printing head occurs in many cases, which is undesirable.

To control the surface tension of ink, various surface tension conditioners can be used. The first example group (group (1)) of these includes: anion surfactants such as higher alcohol sulfate esters, higher alkyl ether sulfate ester, alkyl benzene sulfonate, α-olefin sulfonate, phosphoric ester of ethylene oxide added higher alcohol; amine salt type or quaternary ammonium salt type cation surfactants; amino acid type or betaine type ampholytic surfactants; nonionic surfactants such as ethylene oxide added higher alcohol, ethylene oxide added alkyl phenol, ethylene oxide added fatty acid, ethylene oxide added higher fatty acid amine and fatty acid amide, fatty acid ester of glycerine and pentaeislite, fatty acid ester of cane sugar, fatty acid alchanol amide, block copolymer of ethylene oxide and propylene oxide. Further, silicone type or fluoro type ionic and nonionic surfactants can be used.

Water soluble substances or substances having hydrophilic group, which are not usually considered to be surfactant but have weak surfactant function can also be used. The group (2) of these includes: alkyl ether or alkylphenyl ether of polyvalent alcohols such as propylene glycol, polypropylene glycol, ethylene glycol, diethylene glycol, triethylene glycol, tetraethylene glycol, propylene glycol or glycerine; acid derivatives such as ethylene carbonate, propylene carbonate or ester lactate; alcohols such as isopropyl alcohol, n-butyl alcohol, 2-butanol, isobutyl alcohol, tert-butyl alcohol, pentanols, benzyl alcohol, cyclohexanol; or other substances can be used.

Ink ejected from the print head as an ink droplet contacts the recording medium and penetrates it, which increases the surface area of the ink droplet immediately. Therefore, even if the ink surface tension is controlled to be not more than 40 dyne/cm, if the actual ink surface tension in the interface between the ink and the recording medium exceeds 40 dyne/cm, the effects of this invention decrease. To obtain an adequate effect from this invention, it is preferable to keep the actual ink surface tension not more than 40 dyne/cm when the ink penetrates the recording medium. It is difficult to measure the actual ink surface tension in the interface between the ink and the recording medium when ink penetrates the recording medium, but the relation of the ink surface tension in the interface between ink and the recording medium and the ink penetration into the recording medium can be proved taking advantage of the below described critical micelle concentration.

Generally, when a surfactant is added to ink and if the concentration of the surfactant in ink is at least the critical micelle concentration, the ink surface tension is constant, and the higher the concentration of surfactant the ink has, the more the effect of this invention is realized.

If excessive surfactant is added, secondary problems such as low resolution caused by bubbles, ejection failure or excessive spreading of an image, strike through which means the penetration of ink to the rear side of the medium because of high ink penetration or low reproducing concentration occur, so the concentration of the surface tension conditioner in the ink must be specified carefully. The effects of a surfactant, however, depend on its chemical structure, so it is difficult to specify the concentration thereof in ink to be constant. If a surface tension conditioner in the above described group (1) is used, the content of it should be about 0.1 to 5 percent by weight, preferably about 0.8 to 2.0 percent by weight of the ink to have a good result. If a surface tension conditioner in the above described group (2) is used, the effective content of it is about 1 to 40 percent by weight, preferably about 2 to 15 percent by weight of the ink. It is possible to mix two or more different surface tension conditioners from either or both of these groups. In this case, the combination can be specified on condition that total concentration in ink of the combined conditioners is within the desired concentration.

A fungicide, a viscosity conditioner, a PH conditioner or the like can also be contained in the ink used for the recording method of this invention. Ink viscosity is not particularly specified, but it is preferable that ink viscosity at 20° C. is 1 to 8 cp, particularly 1 to 5 cp in respect of ink jet stability and image quality. Such ink can form a good image by printing on a recording medium of this invention, and if a solid image of 1 cm by 1 cm is recorded on a plain paper such as the electrophotographic transfer medium designated "L", available from Fuji Xerox Co, Ltd, the ink drying time is not more than 10 seconds approximately.

EMBODIMENTS

The present invention is now described in terms of a number of Embodiments and Comparative Embodiments, but is not restricted by the weight proportions described below.

Embodiment 1

In the substrate, a hardwood bleached kraft pulp beaten to have a Freeness of 590 ml C. S. F. was used, and it contained 15 percent by weight of ground lime (Soften 1200 available from Bihoku-funka Kogyo Co., Ltd.) as a filler, 0.04 percent by weight of alkenyl succinic acid hydride (Fibran81 available from Oji National Company, Ltd.) as a sizing agent and 0.8 percent by weight of cationized starch (Cate15 available from Oji National Company, Ltd.) as a fixing agent of the sizing agent. Using these raw materials, a substrate was made to have a basis weight of 75 g/m$^2$ and an apparent density of 0.65 g/cm$^3$. A coating agent having a 70 percent by weight of synthetic amorphous silica powder (Mizukasil P-78D having a BET specific surface of 300 m$^2$ /g available from Mizusawa Industrial Chemicals, Ltd.), 25 percent by weight of completely saponified polyvinyl alcohol (PVA117 available from Kuraray Co., Ltd.) as a binder and 5 percent by weight of water-color cationic polymer (Epomin P1000 available from Nippon Shokubai Kagaku Kogyo Co., Ltd.) was applied to this substrate at a rate of 8 g/m$^2$. The BeKK smoothness of the coating was made to be 28 seconds, and thus a recording medium A was obtained.

Using this recording medium and the below described ink, color recording was carried out. The results of the evaluation are shown in Table 3.

In ink set A in Table 3 comprises 2.5 percent by weight of black ink having a surface tension of 37 dyne/cm, C.I Direct Black 154, 2.5 percent by weight of cyan ink having a surface tension of 38 dyne/cm, C.I Acid Blue 9, 2.5 percent by weight of magenta ink having a surface tension of 37 dyne/cm, C.I Direct Red 227 and 2.5 percent by weight of yellow ink having a surface tension of 36 dyne/cm, C.I Direct Yellow 86 as dye; and 77 percent by weight of water, 12 percent by weight of ethylene glycol and 8.5 percent by weight of diethylene glycol monobutyl ether as a common solvent for black, cyan, magenta and yellow ink.

Embodiments 2 to 15 and Comparative Embodiments 1 to 17

Recording media B to I whose basis weight, apparent density, pulp Freeness, kind and content of filler and internal sizing agent of the substrate were changed respectively based on Embodiment 1 as shown in Table 1, and content of pigment, binder and water fastness agent were also changed respectively based on Embodiment 1 as shown in Table 1, and whose smoothness was made to be 27 to 30 seconds were obtained in the same manner as the making method of recording medium A.

The fillers used for each recording medium B to I were as follows.

For recording medium B, a soft calcium carbonate, TP121 available from Okutama Kogyo Co., Ltd. was used.

For recording medium C, a kaolin, AA kaolin available from Sanyo Clay Co., Ltd. was used.

For recording medium D, a ground lime, Soften 1800 available from Bihoku-funka Kogyo Co., Ltd. was used.

For recording medium E, a soft calcium carbonate, TP121 available from Okutama Kogyo Co., Ltd. was used.

For recording medium F, a soft calcium carbonate, TP121 available from Okutama Kogyo Co., Ltd. was used.

For recording medium G, a ground lime, Soften 1800 available from Bihoku-funka Kogyo Co., Ltd. was used.

For recording medium H, a soft calcium carbonate, TP121 available from Okutama Kogyo Co., Ltd. was used.

For recording medium I, a ground lime, Soften 1800 available from Bihoku-funka Kogyo Co., Ltd. was used.

The internal sizing agents used for each recording medium are as follows.

For recording medium B, an alkyl ketene dimer type sizing agent, Syline H70 available from Kao Corp. was used.

For recording medium C, a Rosin soap sizing agent, SP-E available from Arakawa Chemical Industries, Ltd. was used.

For recording medium D, an alkenyl succinic acid hydride type sizing agent, Fibran81, available from Oji National Company, Ltd. was used.

For recording medium E, an alkyl ketene dimer type sizing agent, Syline H70 available from Kao Corp. was used.

For recording medium F, an alkyl ketene dimer type sizing agent Syline H70 available from Kao Corp. was used.

For recording medium G, an alkenyl succinic acid hydride type sizing agent Fibran81 available from Oji National Company, Ltd. was used.

For recording medium H, an alkyl ketene dimer type sizing agent, Syline H70 available from Kao Corp. was used.

For recording medium I, an alkenyl succinic acid hydride type sizing agent, Fibran81, available from Oji National Company, Ltd. was used.

The pigments used for coatings of each recording medium were as follows.

For recording medium B, a silica, TokusilX37 available from Tokuyama Soda Co., Ltd. was used.

For recording medium C, a silica, MizukasilP-628 available from Mizusawa Industrial Chemicals Ltd. was used.

For recording medium D, a silica, MizukasilP-78D available from Mizusawa Industrial Chemicals Ltd. was used.

For recording medium E, a silica, MizukasilNP-8 available from Mizusawa Industrial Chemicals Ltd. was used.

For recording medium F, a silica, TokusilX37 available from Tokuyama Soda Co., Ltd. was used.

For recording medium G, a silica, MizukasilP-78D available from Mizusawa Industrial Chemicals Ltd. was used.

For recording medium H, a silica, MizukasilP-527 available from Mizusawa Industrial Chemicals Ltd. was used.

For recording medium I, a silica, MizukasilP-78D available from Mizusawa Industrial Chemicals Ltd. was used.

The binders used for coating of each recording medium were as follows.

For recording medium B, a silanol group modified vinyl alcohol copolymer, PVA2130 available from Kuraray Co., Ltd. was used.

For recording medium C, a silanol group modified vinyl alcohol copolymer, PVA2130 available from Kuraray Co., Ltd. was used.

For recording medium D, a polyvinyl alcohol, PVA217 available from Kuraray Co., Ltd. was used.

For recording medium E, a silanol group modified vinyl alcohol copolymer, PVA2130 available from Kuraray Co., Ltd. was used.

For recording medium F, a silanol group modified vinyl alcohol copolymer, PVA2130 available from Kuraray Co., Ltd. was used.

For recording medium G, a polyvinyl alcohol, PVA117 available from Kuraray Co., Ltd. was used.

For recording medium H, a silanol group modified vinyl alcohol copolymer, PVA2130 available from Kuraray Co., Ltd. was used.

For recording medium I, a polyvinyl alcohol, PVA117 available from Kuraray Co., Ltd. was used.

The water fastness agent used for coating of each recording medium were as follows.

For recording medium B, a water-color cation polymer, PAS-Jll available from Nitto Boseki Co., Ltd. was used.

For recording medium C, a water-color cation polymer, EpominP1000 available from Nippon Shokubai Kagaku Kogyo Co., Ltd. was used.

For recording medium D, a water-color cation polymer, EpominP1000 available from Nippon Shokubai Kagaku Kogyo Co., Ltd. was used.

For recording medium E, a water-color cation polymer, PAS-J11 available from Nitto Boseki Co., Ltd. was used.

For recording medium F, a water-color cation polymer, PAS-J11 available from Nitto Boseki Co., Ltd. was used.

For recording medium G, a water-color cation polymer, EpominP1000 available from Nippon Shokubai Kagaku Kogyo Co., Ltd. was used.

For recording medium H, a water-color cation polymer, PAS-J11 available from Nitto Boseki Co., Ltd. was used.

For recording medium I, a water-color cation polymer, EpominP1000 available from Nippon Shokubai Kagaku Kogyo Co., Ltd. was used.

TABLE 1

| | EMBODIMENTS | | | | | COMPARATIVE EMBODIMENTS | | | |
|---|---|---|---|---|---|---|---|---|---|
| Recording medium | A | B | C | D | E | F | G | H | I |
| basis weight (g/m$^2$)*1 | 75 | 70 | 80 | 75 | 70 | 68 | 74 | 70 | 75 |
| Thickness (μm)*1 | 115 | 100 | 109 | 115 | 100 | 87 | 90 | 100 | 115 |
| apparent density*1 | 0.65 | 0.70 | 0.75 | 0.65 | 0.70 | 0.78 | 0.82 | 0.70 | 0.65 |
| pore capacity (ml/m$^2$)*1 | 47 | 42 | 39 | 47 | 42 | 30 | 29 | 42 | 47 |
| pulp filtering degree (ml, CSF)*1 | 590 | 500 | 480 | 590 | 500 | 370 | 340 | 500 | 590 |
| hardwood bleached kraft pulp | | | | | | | | | |
| content of filler (%)*1 | 15 | 13 | 10 | 15 | 13 | 13 | 15 | 13 | 15 |
| content of internal sizing agent (%)*1 | 0.04 | 0.04 | 0.1 | 0.04 | 0.04 | 0.04 | 0.04 | 0.04 | 0.09 |
| Steckigt sizing degree (sec.)*2 | 8 | 10 | 2 | 18 | 10 | 8 | 7 | 10 | 25 |
| BET specific surface of pigment*2 | 300 | 320 | 140 | 300 | 100 | 320 | 300 | 50 | 300 |
| content of pigment (%)*2 | 70 | 72 | 67 | 70 | 72 | 72 | 70 | 72 | 70 |
| content of binder (%)*2 | 25 | 23 | 28 | 25 | 23 | 23 | 25 | 23 | 25 |
| amount of water fastness agent (%)*2 | 5 | 5 | 5 | 5 | 5 | 5 | 5 | 5 | 5 |
| amount of coating agent (g/m$^2$)*2 | 8 | 6 | 5 | 8 | 6 | 6 | 8 | 6 | 8 |

*1:property of SUBSTRATE,
*2:property of COATING

Next, Embodiments 1 to 19, shown in Table 3 and Comparative Embodiments 1 to 17 shown in Table 4 were obtained by combining each of the above described recording medium and ink set A or one of ink sets B to G in Table 2, which were made by changing only the kind and content of the solvent based on ink set A.

TABLE 2

| | solvent | content (percent by weight) | surface tension of each ink (dyne/cm) | |
|---|---|---|---|---|
| ink set A | water | 77 | black | 37 |
| | ethylene glycol | 12 | cyan | 38 |
| | diethylene glycol monobutyl ether | 8.5 | magenta | 37 |
| | | | yellow | 36 |
| ink set B | water | 77 | black | 54 |
| | diethylene glycol | 20.5 | cyan | 53 |
| | | | magenta | 55 |
| | | | yellow | 52 |
| ink set C | water | 73 | black | 32 |
| | diethylene glycol | 20 | cyan | 31 |
| | isopropyl alcohol | 3.5 | magenta | 32 |
| | Sodium alkyl naphthalene sulfonic acid | 1 | yellow | 31 |
| ink set D | water | 85 | black | 33 |
| | glycerine | 10.5 | cyan | 34 |
| | ethylene oxide added nonyl phenol | 2 | magenta | 35 |
| | | | yellow | 33 |
| ink set E | water | 75 | black | 35 |
| | diethylene glycol | 20.5 | cyan | 34 |
| | ethylene oxide and propylene oxide block copolymer | 2 | magenta | 35 |
| | | | yellow | 34 |
| ink set F | water | 69 | black | 27 |
| | ethylene glycol | 25 | cyan | 26 |
| | triethanol amine | 2 | magenta | 27 |
| | sulfosuccinic acid - 2 - ethylhexyl ester sodium salt | 1.5 | yellow | 27 |
| ink set G | water | 77 | black | 42 |
| | diethylene glycol | 10.2 | cyan | 43 |
| | glycerine | 10 | magenta | 42 |
| | ethylene oxide and propylene oxide block copolymer | 0.3 | yellow | 43 |

TABLE 3

| Embodiments | recording medium | ink set | inter-color bleeding | color reproduction quality | resolution | coating layer strength | total |
|---|---|---|---|---|---|---|---|
| 1 | A | A | G4 | G4 | G4 | G3 | G3 |
| 2 | A | B | G2–G3 | G4 | G3 | G3 | G3 |
| 3 | A | C | G4 | G4 | G4 | G3 | G3 |
| 4 | A | E | G4 | G4 | G4 | G3 | G3 |
| 5 | A | F | G4 | G4 | G4 | G3 | G3 |
| 6 | A | G | G2–G3 | G4 | G4 | G3 | G3 |
| 7 | B | A | G4 | G4 | G4 | G4 | G4 |
| 8 | B | B | G3 | G4 | G3 | G4 | G3 |
| 9 | B | C | G4 | G4 | G4 | G4 | G4 |
| 10 | B | D | G4 | G4 | G4 | G4 | G4 |
| 11 | B | G | G3 | G4 | G4 | G4 | G3 |
| 12 | C | A | G3 | G3 | G3 | G4 | G3 |
| 13 | C | B | G2 | G3 | G3 | G4 | G3–G2 |
| 14 | C | D | G3 | G3 | G3 | G4 | G3 |
| 15 | C | G | G2–G3 | G3 | G3 | G4 | G3 |
| 16 | D | B | G2 | G3 | G3 | G4 | G3–G2 |
| 17 | D | E | G3 | G3 | G3 | G4 | G3 |
| 18 | E | B | G2 | G3 | G3 | G4 | G3–G2 |
| 19 | E | D | G3 | G3 | G3 | G4 | G3 |

TABLE 4

| Comparative Embodiment | recording medium | ink set | inter-color bleeding | color reproduction quality | resolution | coating layer strength | total |
|---|---|---|---|---|---|---|---|
| 1 | F | A | G1–G2 | G4 | G4 | G4 | G1–G2 |
| 2 | F | B | G1 | G4 | G4 | G4 | G1 |
| 3 | F | C | G1–G2 | G4 | G4 | G4 | G1–G2 |
| 4 | F | D | G1–G2 | G4 | G4 | G4 | G1–G2 |
| 5 | F | G | G1 | G4 | G4 | G4 | G1 |
| 6 | G | A | G1 | G3 | G3 | G3 | G1 |
| 7 | G | B | G1 | G3 | G2 | G3 | G1 |
| 8 | G | C | G1 | G3 | G3 | G3 | G1 |
| 9 | G | F | G1–G2 | G3 | G3 | G3 | G1–G2 |
| 10 | H | A | G1 | G2 | G1 | G4 | G1 |
| 11 | H | B | G1 | G2 | G1 | G4 | G1 |
| 12 | H | C | G1–G2 | G2 | G1 | G4 | G1 |
| 13 | H | D | G1 | G2 | G1 | G4 | G1 |
| 14 | H | G | G1 | G2 | G1 | G4 | G1 |
| 15 | H | E | G1 | G2 | G1 | G4 | G1 |
| 16 | I | C | G1–G2 | G3 | G3 | G3 | G1–G2 |
| 17 | I | F | G1–G2 | G3 | G3 | G3 | G1–G2 |

Evaluation of these Embodiments and Comparative Embodiments was performed by using a recording apparatus having four recording heads for black, cyan, magenta and yellow ink, and capable of a recording density of 12 dots per 1 mm. The results are shown in Table 3.

Inter-color bleeding was evaluated by superimposing a 1 cm square of a solid image of magenta on a 2 cm square of a solid image of cyan. The superimposed portion produces red by subtractive combination, and bleeding in the border between cyan and red was considered as inter-color bleeding. The results were evaluated by visible inspection as G4, meaning no inter-color bleeding, G3, meaning a very small amount of inter-color bleeding, G2, meaning small amounts of inter-color bleeding, or G1, meaning that significant inter-color bleeding occurred.

Reproduction quality and clarity were evaluated by visible inspection, and the results are shown as G4, meaning excellent, G3, meaning good, G2, meaning normal or G1, meaning poor.

Evaluation of resolution was performed by visibly inspecting the acceptability and the quality of two 8-point complex Ming-cho characters. The results are shown as G4, meaning that both of the acceptability and the quality were excellent, G3, meaning that both of the acceptability and the quality were good, G2, meaning that the characters had degraded to some extent and G1, meaning that the characters were unacceptably degraded.

The strength of the coating of the recording media was evaluated by folding the media and rolling a metal roller of 2 kg on the folded portion, and the results are shown as G4, meaning no peeling, G3, meaning peeling a little, G2, meaning a small amount of peeling or G1, meaning much peeling.

What is claimed is:

1. An ink jet recording medium, comprising a surface coating on at least one surface of a substrate, said substrate having an apparent density of 0.60 to less than 0.75 g/cm$^3$ and a Steckigt sizing degree of 2 to 18 seconds and said coating being formed by applying a coating agent containing a white pigment at a rate in the range of 2 to 10 g/m$^2$, said white pigment present in said coating agent having a BET specific surface of from 200 to 350 m$^2$/g.

2. The ink jet recording medium claimed in claim 1, wherein the content of white pigment in said coating agent is 50 to 85 percent by weight.

3. The ink jet recording medium claimed in claim 1, wherein said apparent density is 0.65 to 0.73 g/cm$^3$.

4. The ink jet recording medium claimed in claim 1, wherein said substrate has a thickness of 65 to 150 micrometers.

5. The ink jet recording medium claimed in claim 1, wherein said substrate has a pore capacity is at least 37 ml/m$^2$.

6. The ink jet recording medium claimed in claim 1, wherein said substrate has a pulp freeness of 350 to 750 ml CSF.

7. The ink jet recording medium claimed in claim 1, wherein said substrate has a pulp freeness of 400 to 700 ml CSF.

8. An ink jet recording medium comprising a coating on at least one surface of a substrate, said substrate having an apparent density of 0.60 to less than 0.75 g/cm$^3$ and a Steckigt sizing degree of 2 to 18 seconds, said coating being formed by applying a coating agent containing a white pigment at a rate in the range of 2 to 10 g/m$^2$, said white pigment being present in said coating agent in an amount of 50 to 85 percent by weight of said coating agent and said white pigment having a BET specific surface of 100 to 400 m$^2$/g.

9. An ink jet recording medium, comprising a surface coating on at least one surface of a substrate, said substrate having an apparent density of 0.60 to less than 0.75 g/cm$^3$ and a Steckigt sizing degree of 2 to 18 seconds and said coating being formed by applying a coating agent containing white pigment at a rate in the range of 2 to 10 g/m$^2$, all of said white pigment present in said coating agent having a BET specific surface of from 200 to 350 m$^2$/g.

* * * * *